US005812355A

United States Patent [19]

Nojima

[11] Patent Number: 5,812,355

[45] Date of Patent: Sep. 22, 1998

[54] ELECTRIC GUN DRIVER

[75] Inventor: Geraldo Nojima, Duluth, Ga.

[73] Assignee: Nordson Corporation, Westlake, Ohio

[21] Appl. No.: 533,519

[22] Filed: Sep. 25, 1995

[51] Int. Cl.[6] ..... H01H 47/04

[52] U.S. Cl. ..... 361/152; 361/154

[58] Field of Search ..... 361/152, 154

[56] References Cited

U.S. PATENT DOCUMENTS

| | | | |
|---|---|---|---|
| 3,864,608 | 2/1975 | Normille et al. | 317/148.5 R |
| 4,173,030 | 10/1979 | Rabe | 361/154 |
| 4,438,478 | 3/1984 | Matsuyama | 361/152 |
| 4,453,652 | 6/1984 | Merkel et al. | 222/504 |
| 4,454,466 | 6/1984 | Ritter | 323/258 |
| 4,470,095 | 9/1984 | Donig | 361/153 |
| 4,630,165 | 12/1986 | D'Onofrio | 361/154 |
| 4,878,147 | 10/1989 | Oyama et al. | 361/154 |
| 4,890,188 | 12/1989 | Russell et al. | 361/154 |
| 4,949,215 | 8/1990 | Studtmann et al. | 361/154 |
| 5,233,543 | 8/1993 | Hoglund et al. | 364/551.01 |
| 5,416,665 | 5/1995 | Nishikawa et al. | 361/154 |
| 5,469,825 | 11/1995 | Golab et al. | 361/154 |
| 5,513,088 | 4/1996 | Williamson | 363/20 |
| 5,539,608 | 7/1996 | Hurley et al. | 361/154 |
| 5,621,603 | 4/1997 | Adamec et al. | 361/154 |

FOREIGN PATENT DOCUMENTS

| | | |
|---|---|---|
| 0 080 795 A | 6/1983 | European Pat. Off. . |
| 0 376 493 A | 7/1990 | European Pat. Off. . |
| 2 568 715 A | 2/1986 | France . |
| 62-120006 A | 11/1987 | Japan . |
| 95 00960 A | 1/1995 | WIPO . |

OTHER PUBLICATIONS

E28 Electric Gun Driver Manual (Nordson), ©1994.

*"The Analysis, Design and Manufacturing of Three–Phase, Large–Power, Switch Type Rectifier,"* Power Electronics Technology, pp. 23–33 (Apr. 1995).

*Primary Examiner*—Fritz Fleming

*Attorney, Agent, or Firm*—Renner, Kenner, Grieve, Bobak, Taylor & Weber

[57] ABSTRACT

An electric gun driver for controlling a solenoid within a dispenser which dispenses a liquid material, such as a heated adhesive, for application to packaging materials. The electric gun driver includes a switch mode power supply for receiving a wide range of input voltages so that the electric gun driver is adaptable to various power supply systems throughout the world. The improved electric gun driver also includes a computer for monitoring and regulating the operation of the dispenser device, a power circuit, and a hysteresis band modulator for receiving a reference current from the computer and a feedback current from an operational amplifier so as to provide a modulation signal to the power circuit. The power circuit includes two switches in the form of insulated gate bipolar transistors respectively controlled by gate driver and detector circuits so as to modulate the solenoid current for controlling and regulating the dispenser. The power circuit is controlled by the computer in such a manner that the solenoid receives a fast pull-in current and then modulates one of the two IGBT switch devices so as to provide the minimum required holding current to hold the dispenser in the desired position. The power circuit is also configured such that when the switches/IGBTs are opened or toggled to an off position, the magnetizing current within the solenoid is dissipated so as to quickly close the dispenser.

11 Claims, 2 Drawing Sheets

ELECTRIC GUN DRIVER

TECHNICAL FIELD

Generally, the present invention resides in the art of dispensing devices used to dispense fluids, such as adhesives, sealants, caulks and the like. More particularly, the present invention is an electric gun driver employed to control a solenoid contained within the dispenser, sometimes referred to as a module or gun. Specifically, the present invention is directed toward an electric gun driver circuit that controls the current supplied to the solenoid to provide rapid opening and closing of the dispensing gun for repeatable accurate bead patterns while minimizing heat build-up within the dispensing gun.

BACKGROUND OF THE INVENTION

It is known in the packaging industry to provide dispensing devices that dispense liquid adhesive on packaging materials in spots or any other desired pattern. The packaging material is then folded in a predetermined manner so that the disposed adhesive comes in contact with mating portions of the packaging material to form the desired container or package. Due to the high speed nature of this assembly process, dispensing devices have been developed using electrical control systems.

Known dispensing devices include a valve type system containing a plunger received within an orifice, wherein a solenoid is employed to control the movement of the plunger from a closed position to a dispensing position and back again to a closed position.

Dispensing devices have been developed employing electric circuit controls to enhance the operation of the solenoid. Many factors contribute to the efficient operation of such dispensing devices including, but not limited to, the viscosity of the adhesive to be applied, the heat generated by the resistance and inductance of the solenoid, the heat of the fluid or adhesive to be applied, and the desired pattern of the adhesive. It is also important in the operation of such dispensing devices that the solenoid acts upon the plunger to quickly open and quickly close the orifice when desired. To achieve this operation, the gun driver applies a fast pull-in current to the solenoid to quickly open the orifice at the beginning of the dispensing cycle. Additionally, the gun driver maintains a minimal holding current which holds the plunger in an open position while minimizing the amount of heat build-up in the solenoid coil during dispensing. Finally, the gun driver provides a fast demagnetization of the solenoid coil so that the plunger is quickly closed upon the orifice at the end of the dispensing cycle.

Various electric gun driver circuits have been developed in an attempt to achieve a solenoid device responsive to a fast pull-in current, a minimized holding current and a fast demagnetization of the solenoid. Although these known dispensing gun devices and electric gun circuit drivers have been found somewhat effective in performing their desired function, the current dispensing gun devices have numerous limitations. In particular, current dispensing gun devices do not employ closed loop technology wherein the status of the solenoid coil current is continually regulated by compensating for fluctuations in heat or other such variables. Nor do current electric gun driver circuits provide compensation for fluctuations in the line voltage applied to the device. In other words, major modifications are required to dispensing gun devices when they are connected to different power supply systems. These power supply systems can range between from 100 to 240 volts AC, and 50 to 60 Hertz frequency. A further drawback of current electric gun driver circuits is that they are only capable of driving a maximum of two solenoids. Yet another drawback of current electric gun driver circuits is that they do not provide ground fault detection nor do they provide automatic adjustment of current levels for operating the solenoid.

Based upon the foregoing, it is apparent that there is a need for an improved electric gun device with an electric gun driver circuit which controls the flow of a liquid through the dispensing gun device. Moreover, there is a need in the art for an electric gun driver circuit that may simultaneously drive multiple solenoids and which can provide the necessary controls to ensure a fast pull-in current, a minimal holding current and a method for quickly demagnetizing the solenoid.

DISCLOSURE OF INVENTION

In light of the foregoing, it is a first aspect of the present invention to provide an improved electric gun driver circuit for dispensing gun devices.

Another aspect of the present invention is to provide an electric gun driver circuit, as set forth above, controlled by a computer with operator supplied commands.

Still a further aspect of the present invention is to provide an electric gun driver circuit, as set forth above, with a switch mode power supply for accepting a wide range of line voltages which are then isolated from user interfaces without adjusting any of the components contained within the electric gun driver circuit.

An additional aspect of the present invention is to provide an electric gun driver circuit, as set forth above, which has the capability of simultaneously controlling more than four solenoids.

Yet an additional aspect of the present invention is to provide an electric gun driver circuit, as set forth above, having a hysteresis band modulator to provide regulated pull-in and holding currents according to a current reference set by a computer.

Another aspect of the present invention is to provide an electric gun driver circuit, as set forth above, having a fault detection system which detects ground faults, shorts and the like.

Yet a further aspect of the present invention is to provide an electric gun driver circuit, as set forth above, that can quickly dissipate the magnetic field of the solenoids so as to provide a quick release of a plunger controlled by the solenoid to stop the flow of fluid through the dispensing gun.

The foregoing and other aspects of the invention which shall become apparent as the detailed description proceeds are achieved by an electric gun driver for use with a dispenser, comprising: a solenoid with a movable armature to regulate the flow of fluid through the dispenser; a switch mode power supply for receiving a range of line voltages for conversion to an operating voltage; and a power circuit for receiving a line current correlating to the line voltage, supplied to the solenoid for selectively moving the movable armature.

Other aspects of the invention which will become apparent herein are attained by an electric gun driver for use in a dispenser, comprising: a solenoid with a movable armature to regulate the flow of fluid through the dispenser; a computer for receiving inputs to generate a reference current to regulate the movement of the movable armature; and a power circuit for receiving a modulation signal correlating to the reference current for selectively moving the movable armature.

Still additional aspects of the invention which will be noted herein are achieved by an electric gun driver for use in a dispenser, comprising: a movable armature operative with an orifice, wherein the movement of the movable armature is controlled by a solenoid; a power circuit electrically connected to said solenoid, wherein the power circuit generates a pull-in current and a holding current having a value less than the pull-in current, and wherein the power circuit quickly dissipates the holding current when required, the power circuit receiving a range of input voltages; a switch mode power supply for receiving the range of input voltages for conversion to an operating voltage; a computer for receiving the operating voltage and an operator input for enabling the operation thereof and for generating a reference current; and a hysteresis band modulator for receiving the reference current and generating a modulation signal for controlling the pull-in current and the holding current received by the solenoid.

BEST MODE FOR CARRYING OUT THE INVENTION

Figure 1:
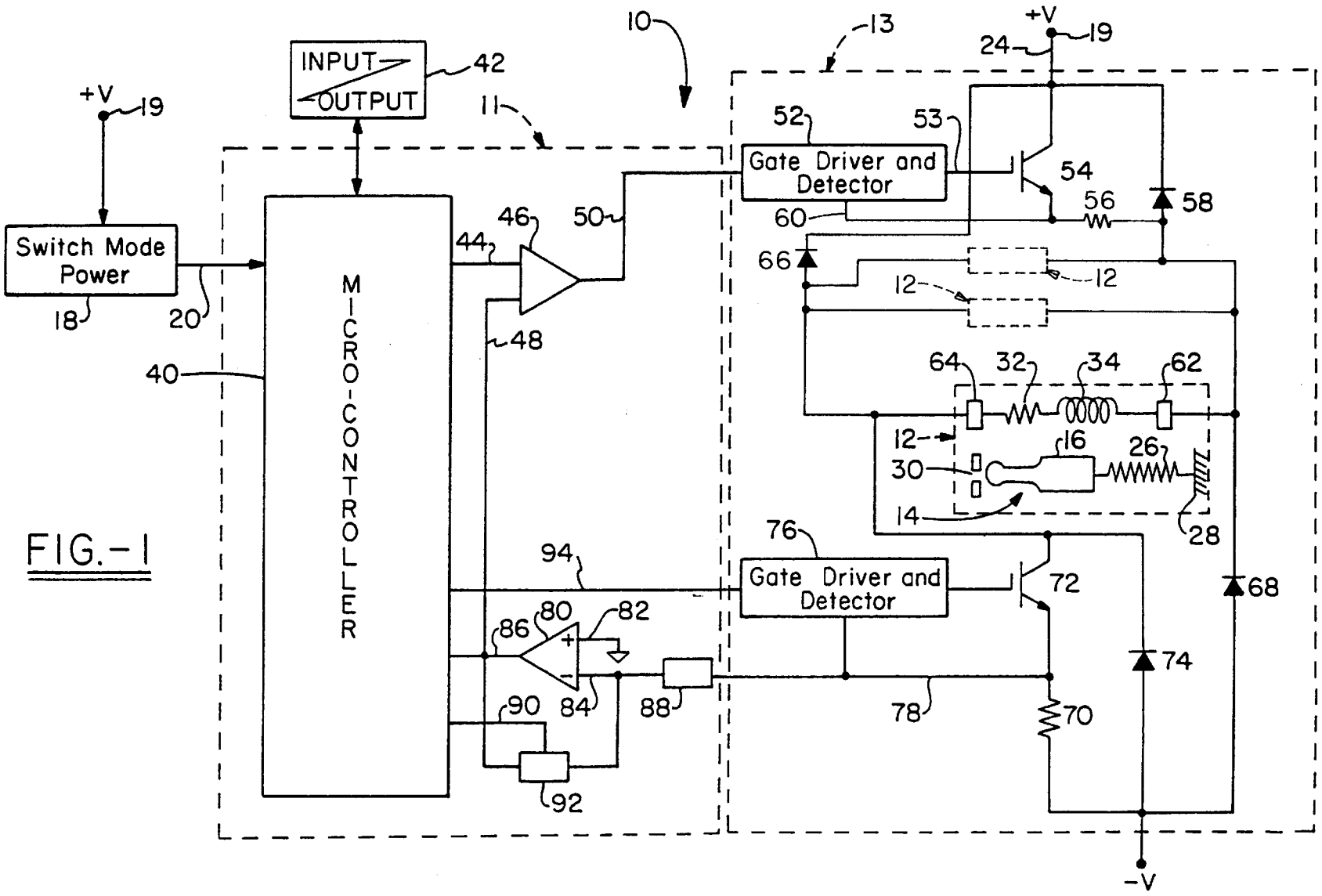
FIG. 1 is a schematic diagram of an electric gun driver circuit according to the present invention.

Referring now to FIG. 1, it can be seen that an improved electric gun driver according to the present invention is designated generally by the numeral 10. Generally, the gun driver 10 includes a control circuit 11, a dispenser 12 which has a solenoid 14 with a movable armature or plunger 16 to regulate the flow of fluid through the dispenser 12, and a power circuit 13. The gun driver 10 also has a switch mode power supply 18 for receiving a range of line voltages 19 for conversion to an isolated supply voltage 20. The power circuit 13 receives a line current 24 correlating to the line voltage 19 supplied to the solenoid 14 for selectively moving the armature 16. As will be described in further detail hereinbelow, the electric gun driver 10 regulates and controls the flow of liquid, such as a liquid based adhesive, through the dispenser 12 in any desired pattern or sequence.

In particular, the armature 16 is biased by a spring 26 that is interposed between the armature and a fixed reference 28. The armature 16 is in an operative relationship with an orifice 30 such that when the armature 16 is moved, the liquid contained within the dispenser 12 is permitted to flow under pressure through the orifice 30 onto the desired object. As is well known in the art, the armature 16 is actuated by the application of current through the coil of the solenoid 14 which has a resistance 32 and an inductance 34. While only one solenoid 14 is shown, it will be appreciated that multiple solenoids, where all solenoids are the same type, could be driven by the gun driver 10.

To ensure the proper operation of the dispenser 12 it is imperative that actuation of the armature 16 be precisely controlled. To accomplish this, current is rapidly supplied to the solenoid 14. This rapid application of current, commonly known as a "pull-in" current, is required to overcome the force applied by the spring 26 and the viscosity of the fluid contained within the dispenser 12. Once the armature 16 has been drawn away from the orifice 30, the amount of current, or "holding current", required to hold the armature 16 in place is greatly reduced. Moreover, due to the large amount of heat created by the pull-in current through the solenoid coil, it is desirable to have a holding current that is reduced in value so as not to adversely affect the viscosity of the fluid flowing through the dispenser 12. Finally, when the dispenser 12 is to be closed, the energy stored within the solenoid inductance 34 should be rapidly dissipated so as to quickly close the movable armature 16 upon the orifice 30. This is especially important in an assembly line operation where the opening and closing of the dispenser 12 is critical to the smooth operation of the assembly process.

The switch mode power supply 18 is capable of receiving a wide range of input voltages 19 so as to allow the gun driver 10 to be easily adapted to any electrical power source throughout the world. By employing the switch mode power supply 18 and maintaining a current hysteresis band around a current reference level, all user interfaces are isolated from the main power and as such the gun driver 10 may operate on any line voltage ranging from 100 to 240 volts AC, and operate at a frequency of 50 to 60 Hz without any other adjustments to the gun driver 10. The switch mode power supply 18 operates at 60 KHz in a fly back topology, with a +5 volt logic supply as the regulated secondary voltage. The switch mode power supply 18 receives these wide ranges of line voltages 19 and generates an isolated supply voltage 20 for use by the gun driver 10.

In the control circuit 11, a computer 40 is employed to precisely regulate and control the application of the pull-in current, the holding current and the removal thereof from the solenoid 14 so as to ensure the proper operation of the gun driver 10. In the preferred embodiment, the computer 40 is commercially available from the Motorola Corporation of Schaumberg, Ill. as their Part No. MC68HC11F1. The computer 40 is enabled by the isolated supply voltage 20 and also receives customer supplied input on an input/output device 42 for generating a current reference 44. In particular, the computer 40 allows the operator to designate the duration of the pull-in current and the holding current. This allows the electric gun 10 to be adapted to any given application's energy and timing requirements and therefore improve its performance. If the particular application of the gun driver 10 requires low viscosity adhesives, it is required that the pull-in time be extended. Likewise, where the application of short dots or a high viscosity or low temperature adhesive is required, the period of the pull-in current can be significantly shortened allowing a larger number of cycles per minute in the gun dispenser 12. It will also be appreciated that the computer 40 can sense various malfunctions within the gun driver and the power circuit 13 and relay this information to the operator of the device by display on the input/output device 42. It should also be appreciated that by using the computer 40, the electric gun driver 10 can operate multiple solenoids simultaneously.

Also in the control circuit 11 is a hysteresis band modulator 46 which regulates the pull-in and holding currents by establishing a certain current hysteresis band around a current reference level and pulse width modulates the line voltage 19 applied to the power circuit 13 to keep the actual solenoid current inside this hysteresis band. The hysteresis band modulator 46 allows a wide range of input voltages to be applied to one type of solenoid and accommodates wide solenoid temperature variations in order to keep the pull-in and holding currents at their desired levels. In order to properly perform this function, the hysteresis band modulator 46 also receives a feedback current 48 to generate a modulation signal 50 also referred to as a voltage command. As will be discussed hereinbelow, the modulation signal 50 is generated by the current reference 44 and the feedback current 48 in such a manner that the feedback current 48 tracks the current reference 44.

In general, the power circuit 13 receives the voltage command from the hysteresis band modulator 46 and line voltage from the input voltage 19 to amplify the voltage command for operation of the solenoid 14. In particular, the power circuit 13 receives the modulation current 50 at a gate driver and fault detector 52. The gate driver and fault detector 52 generates a driver signal 53 so as to control the operation of an insulated gate bipolar transistor (IGBT) 54 which functions as a switch. It will be appreciated that the driver signal 53 is received by the base of the IGBT 54 while the collector thereof is connected to the line current 24 and the emitter is connected to a resistor 56. Accordingly, the switch IGBT 54 is effectively closed by application of drive signal 53. The collector of the IGBT 54 is also connected to the cathode of a diode 58 while the anode of the diode 58 is connected to the opposite side of the resistor 56. A detection line 60 is connected between the resistor 56 and the emitter of IGBT 54 so as to provide a ground fault or short circuit detection signal to the gate driver and fault detector 52. A terminal 62 of the solenoid 14 is connected to the anode of the diode 58. The opposite end of the solenoid 14 has a terminal 64 which is connected to the anode of a diode 66. The cathode of diode 66 is electrically connected to the line voltage 19.

Electrically connected to the terminal 62 is a diode 68. The cathode of diode 68 is connected to terminal 62 while the anode of diode 68 is connected to the opposite polarity of line voltage 19. Also connected to the opposite polarity of line voltage 19 is a resistor 70 which at its opposite end is connected to the emitter of an insulated gate bipolar transistor (IGBT) 72 which functions as a switch. Also connected to the first end of the resistor 70 is the anode of a shunt diode 74 which has its cathode connected to the collector of IGBT 72. Connected to the base of the IGBT 72 is a gate driver and fault detector 76. As such, the switch/IGBT 72 is effectively closed by a signal generated by the gate driver and detector 76. A current feedback signal 78 is provided from the emitter of the IGBT 72 to the gate driver and fault detector 76.

An operational amplifier 80, which is a part of the control circuit 11, receives the current feedback signal 78. The operational amplifier 80 has a non-inverting input 82 that is connected to ground, an inverting input 84 which receives the current feedback signal 78 and an output 86. The output 86 of the operational amplifier 80 provides the feedback current 48 which is also received by the computer 40. In order to properly control the gain or amplification factor of the operational amplifier 80, the computer 40 provides an adjustment signal 90 to a variable resistor 92. One end of the variable resistor 92 is connected to the non-inverting input 84 while the opposite end of the variable resistor 92 is connected to the output 86 of the operational amplifier 80. The computer 40 also provides a demagnetization signal 94 to the power circuit 13 and ultimately to the gate driver and fault detector 76 to control the operation of switch/IGBT 72.

In operation, the gun driver 10 receives an input line voltage 19 which is received by both the switch mode power supply 18 and the power circuit 13. The switch mode power supply 18 converts the line voltage 19 to an isolated supply voltage 20 which is received by the computer 40, to properly sequence and control the operation of the dispenser 12. The computer 40 also receives operator input 42 to determine the mode of operation of the solenoid 14.

In order to properly understand the operation and control of the solenoid 14 a general overview of the operation of the hysteresis band modulator 46, the power circuit 13, and the operational amplifier 80 will be provided. Prior to energizing the solenoid 14, both of the switches/IGBT's 54 and 72 are toggled to the open or off position. At this time, the hysteresis band modulator 46 is not receiving any signal from the computer 40 or from the operational amplifier 80. Once the computer 40 determines what the required pull-in current value and the holding current value are, both the switches/IGBTs 54 and 72 are toggled to the closed or on position. This allows for the rapid increase in the pull-in current required to move the movable armature 16 to an open position on the dispenser 12. Once the desired pull-in current reaches a set value predetermined by the computer 40, the hysteresis band modulator 46 modulates the switches/IGBT 54 between an on and off position. This allows the solenoid 14 to receive a controlled current to maintain the desired set value. Subsequently, the computer 40 reduces the current reference 44 so that a holding current value is attained and maintained. Once the computer 40 has determined that the duration of the holding current is complete, both switches/IGBTs 54 and 72 are toggled to the open or off position. At this time, the energy stored within the inductance 34 is quickly dissipated so as to release the movable armature 16, close the orifice 30, and stop the dispensing of fluid.

A detailed description of this operation will now be provided with reference to all the drawings. In particular, the computer 40 provides the reference current 44 to the hysteresis band modulator 46. At this time the feedback current 48 is not generated so that an on signal is generated by the modulation signal 50 and received by the gate driver and fault detector 52 to close the switch/IGBT 54. Simultaneous with the application of current reference 44, the computer 40 is generating a signal 94 to the gate driver 76 so that both the IGBTs 54 and 72 are closed or toggled to the on position. Thus it will be appreciated that the line current 24 is conducted through switch/IGBT 54, through the resistor 56 and to the terminal 62 of the solenoid 14 to open the dispenser 12. The line current 24 is then conducted through the terminal 64, through the switch/IGBT 72 to the resistor 70 and to the minus polarity of the line voltage 19. For example, the pull-in or peak current reference provided by the computer 40 is supplied to the hysteresis band modulator 46 having a predetermined value that is dependent on the parameters of the solenoid 14. After this peak current has been applied for a predetermined period, the operational amplifier 80 receives the current feedback signal 78. Also received at the input 84 is the adjustment signal 90, which is controlled by the computer 40, for adjusting the amplification factor or gain of amplifier 80. Accordingly, the operational amplifier 80 generates a feedback signal 48 to the hysteresis band modulator 46. Those skilled in the art will appreciate that the hysteresis band modulator 46 is only turned on at a predetermined reference value and is only turned off at a predetermined value greater than the predetermined reference value. For example, the hysteresis band modulator 46 generates the modulation signal 50 until the feedback current 48 exceeds the current reference value by anywhere from about five to about ten percent. Once the hysteresis band modulator 46 is toggled to an off position the modulation signal 50 generates an appropriate signal to the gate driver and detector 52 to open or turn off the switch/IGBT 54. Accordingly, due to the counter-electromotive force of the inductance 34, the polarity of the voltage applied to solenoid 14 is reversed. As such, terminal 64 becomes the positive terminal and terminal 62 becomes the negative terminal. Since the gate driver and fault detector 76 continues to maintain the switch/IGBT 72 in an on position, the current within the inductance 34 loops from the positive terminal 64 through the switch/IGBT 72 and the diode 68 to the negative terminal 62 for a time constant of L/R as provided by the solenoid 14, where L is the value of the inductance 34 and R is the value of the resistance 32. As the current within this loop begins to dissipate through the resistor 70, the current feedback signal 78, signals the operational amplifier 80 and accordingly the feedback signal 48 is scaled and drops to a value less than the current reference 44. Once this occurs, the hysteresis band modulator 46 again generates an on modulation signal 50 to the gate driver and fault detector 52 so as to provide an on driver signal 53 to the switch/IGBT 54 which toggles the switch/IGBT 54 into a closed or an on position. It will be appreciated then that the polarity of the terminals 62 and 64 are again reversed so that terminal 62 is the positive terminal and terminal 64 is the negative terminal. Those skilled in the art will appreciate then that the pull-in current is modulated between a range of current values by maintaining switch/IGBT 72 in an on position while the switch/IGBT 54 is toggled between an on and off position as determined by the time constant of the solenoid 34 and the gain value of the operational amplifier 80 controlled by the computer 40.

Upon completion of the pull-in current phase, as determined by operator input and the computer 40, the switch/IGBT 54 is opened or toggled off for a predetermined period of time to reduce the pull-in current value to the holding current value. In the same manner described above, the holding current is then maintained within a band or range of current values by modulating switch/IGBT 54 on and off. Of course, the computer 40 generates the necessary reference current 44 to attain and maintain the holding current value.

At such time that the computer 40 determines that the open cycle of the dispenser 12 is complete, the computer 40 simultaneously turns off both gate drivers 52 and 76 which in turn respectively opens or turns off switches/IGBTs 54 and 72. Once this occurs it will again be appreciated that the terminals 62 and 64 are reversed due to the counter electromotive force of the inductor 34. As such, terminal 64 is positive and terminal 62 is negative. With this being the case, the inductance 34 is quickly dissipated since the positive terminal 64 conducts through the anode of the diode 66 and the negative terminal 62 conducts through the cathode of diode 68 to the negative polarity of line voltage 19. Thus it will be appreciated that the moveable armature 16 is quickly released from the magnetic pull of the solenoid 34 so that a quick closure of the dispenser 12 is achieved.

Figure 2A:
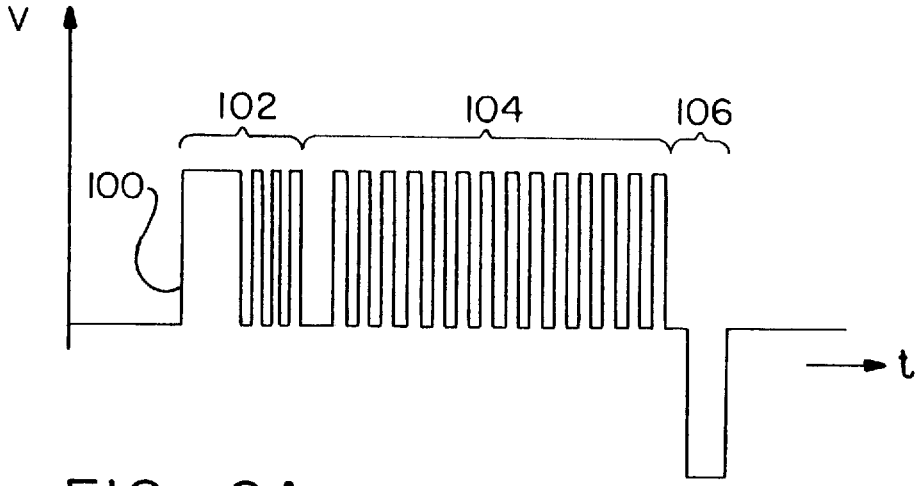
FIG. 2A is a waveform depicting a voltage value applied to a dispensing device.
Figure 2B:
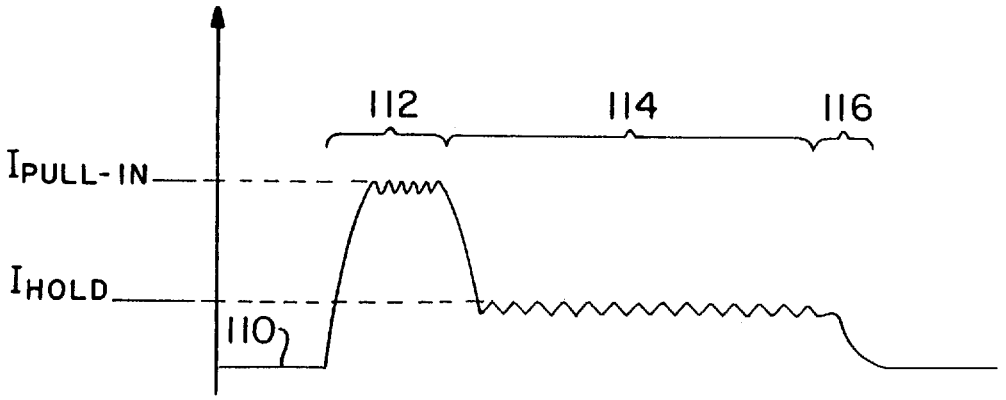
FIG. 2B is a waveform depicting a current value applied to a dispensing device.

The above operational description of gun driver 10 is presented in FIG. 2A and FIG. 2B. In particular, FIG. 2A shows a voltage waveform 100 where portions 102, 104 and 105 represent distinct phases of the voltage applied to dispenser 12. FIG. 2B shows a corresponding current waveform 110 where portions 112, 114 and 116 represent the pull-in current, the holding current and the dissipating current respectively. Portion 102 and corresponding portion 112 exemplify when both switches/IGBT's 54 and 72 are toggled on to allow the necessary current level required to pull the armature 16 away from the orifice 30 into an open position. During portions 102 and 112, switch/IGBT 54 is modulated off and on for a predetermined period of time, until such time that the computer 40 determines that the pull-in phase is complete. Portion 104 and corresponding portion 114 exemplify when switch/IGBT 72 is on and switch/IGBT 54 is turned off for a predetermined period and is then modulated on and off to maintain a holding current, which is at a reduced value from the pull-in current, to hold the dispenser 12 in an open position. Portion 106 and corresponding portion 116 exemplify when both switches/IGBTs 54 and 72 are turned off to quickly de-energize solenoid 14, effectively closing the armature 16 upon the orifice 30.

Referring back to FIG. 1, another feature of the power circuit 13 is the ground fault and short detector aspects of the gate drivers 52 and 76. It will be appreciated that resistor 56 provides a detection line 60 to the gate driver and fault detector 52. In a similar manner, the resistor 70 provides the current feedback signal 78 to the gate driver and fault detector 76. When either a ground fault or short circuit is detected by either resistor 56 or 70, an appropriate signal is sent to the respective gate driver so as to stop the operation of the power circuit 22. It will also be appreciated then that the gate drivers 52 and 76 send an appropriate signal to the computer 40 which displays an error message on the input/output device 42.

It is apparent then from the description of the operation of the electric gun driver 10 that the problems associated with previous electric gun drivers have been overcome. In particular, the electric gun driver 10 provides a fast pull-in current, a regulated holding current, and a method for demagnetizing the solenoid 14 that has heretofore been unknown in the art. Furthermore, the power circuit 13 provides a method for both ground fault and short circuit detection by use of gate drivers 52 and 76 which can receive sensing signals from resistors 56 and 70 contained within the power circuit 22.

Yet another advantage of the present invention is that the hysteresis band modulator 46 allows for closed loop control of the dispenser 12. This allows the use of one type of solenoid for 120 VAC or 240 VAC or any voltage value therebetween. In other words, as the computer senses an unexplained change in the feedback current 48, the variable resistor 92 is adjusted to maintain the desired open and close cycle times of the dispenser 12.

Thus, it can be seen that the objects of the invention have been satisfied by the structure presented above. It should be apparent to those skilled in the art that the objects of the present invention could be practiced with a wide range of input voltages and be adapted for use with multiple solenoids.

While the preferred embodiment of the invention has been presented and described in detail, it will be understood that the invention is not limited thereto or thereby. As such, similar configurations may be used in the construction of the invention to meet the various needs of the end user. Accordingly, for an appreciation of the true scope and breadth of the invention, reference should be made to the following claims.

What is claimed is:

1. An electric gun driver for use with a plurality of dispensers, comprising:

a plurality of like solenoids each with a movable armature to regulate the flow of fluid through each dispenser;

a switch mode power supply for receiving a range of line voltages for conversion to an operating voltage;

a power circuit for receiving a voltage command signal and said line voltage, wherein said command signal is amplified by said line voltage and supplied to each said solenoid for selectively moving each said movable armature;

a controller for receiving operator inputs and said operating voltage for generating a reference current to regulate the application of said line voltage to each said solenoid;

a hysteresis band modulator for receiving said reference current and a feedback current so as to generate a modulation signal received by said power circuit, wherein said modulation signal is generated by said reference current and said feedback current, such that said feedback current tracks said reference current, and wherein said reference current is initially set by said controller to a pull-in value and after a predetermined period of time said reference current is set by said controller to a holding value; and an amplifier for scaling said feedback current, wherein said controller adjusts the gain of said operational amplifier so as to regulate the value of said feedback current.

2. The electric gun driver according to claim 1, wherein said power circuit further comprises:

a first gate driver electrically connected to a first switch for regulating the flow of said line current to said solenoid, said first gate driver enabled by said modulation signal; and a second gate driver electrically connected to a second switch for regulating the flow of said line current to said solenoid, said second gate driver enabled by a signal from said computer; wherein said first and second switches are closed such that said line current attains a predetermined pull-in value for a predetermined period of time to open the dispenser, wherein one of said first and second switches modulates between a closed and an open position so that said line current maintains said pull-in value and subsequently attains a holding value for a predetermined period of time to hold said dispenser in a predetermined position, and wherein said first and second switches are opened to remove said line current from said solenoid so as to close the dispenser.

3. The electric gun driver according to claim 2, wherein said first and second gate drivers have detectors for detecting short circuits and ground faults in said power circuit and for opening said first and second switches upon the occurrence of the short circuits and ground faults.

4. An electric gun driver for use in a dispenser, comprising:

a switch mode power supply for receiving a range of line voltages for conversion to an operating voltage;

a computer for receiving said operating voltage and inputs to generate a reference current and a corresponding modulation signal; and a power circuit for receiving said range of line voltages and said modulation signal for selectively moving at least one movable armature within at least one solenoid to regulate the flow of fluid through the dispenser, said power circuit generating a feedback current received by said computer to adjust said modulation signal, wherein said computer adjusts a resistance value, which in turn adjusts the gain of an amplifier to regulate the value of said feedback current to maintain a desired cycle time of the dispenser.

5. The electric gun driver according to claim 4, further comprising:

a hysteresis band modulator for receiving said reference current and said feedback current so as to generate said modulation signal received by said power circuit, wherein said modulation signal is generated by said reference current and said feedback current, such that said feedback current tracks said reference current and wherein said modulation signal is stopped whenever said computer discontinues generating said reference current.

6. The electric gun driver according to claim 5, wherein said power circuit further comprises:

a first switch controlled by said modulation signal and wherein one end of said first switch is connected to one end of said solenoid; and a second switch controlled by a signal generated by said computer and wherein one end of said second switch is connected to the opposite end of said solenoid, and wherein said first and second switches are closed to provide a line current correlating to said line voltage that attains a predetermined pull-in value for a predetermined period of time to move said movable armature, wherein one of said first and second switches modulates between a closed position and an open position so that said line current maintains a pull-in value and subsequently attains a holding value for a predetermined period of time to hold said movable armature in a predetermined position, and wherein said first and second switches are opened to remove said line current for releasing said movable armature.

7. The electric gun driver according to claim 6, wherein said first and second switches are electrically connected to respective first and second gate drivers, wherein said first gate driver receives said modulation signal and generates a driver signal received by said first switch, and wherein said first and second gate drivers have detectors for detecting short circuits and ground faults in said power circuit and for opening said first and second switches upon the occurrence of short circuits and ground faults.

8. An electric gun driver for use in a dispenser, comprising:

a movable armature operative with an orifice, wherein the movement of said movable armature is controlled by a solenoid;

a power circuit electrically connected to said solenoid, wherein said power circuit generates a pull-in current and a holding current having a value less than the pull-in current, and wherein said power circuit quickly dissipates the holding current when required, said power circuit receiving a range of input voltages to power said solenoid;

a switch mode power supply for receiving said range of input voltages for conversion to an operating voltage;

a computer for receiving said operating voltage and an operator input for enabling the operation thereof and for generating a reference current that is initially set to a pull-in value for a predetermined period of time and then reduced to a holding value for a predetermined period of time and then reduced to zero;

a hysteresis band modulator for receiving said reference current and generating a modulation signal for controlling the pull-in current and the holding current received by said power circuit and said solenoid; and an amplifier for generating a feedback current which is received by said hysteresis band modulator, and wherein said modulation signal is generated by said reference current and said feedback current, so said feedback current tracks said reference current, and wherein said computer adjusts the gain of said amplifier so as to regulate the value of said feedback current.

9. The electric gun driver according to claim 8, wherein said computer can simultaneously control multiple solenoids and wherein said computer receives and adjusts said feedback current accordingly.

10. The electric gun driver according to claim 9, wherein said power circuit further comprises:

a first driver coupled to a first switch for regulating the flow of the pull-in current and the holding current to said solenoid, said first driver enabled by said modulation signal; and a second driver coupled to a second switch for regulating the flow of the pull-in and the holding current to said solenoid, said second driver enabled by a signal from said computer.

11. The electric gun driver according to claim 10, wherein said first and second switches are closed for a predetermined period of time so as to generate the pull-in current, and wherein one of said first and second switches is modulated between a closed position and an open position so as to maintain said pull-in current and subsequently generate said holding current between a corresponding range of predetermined values, and wherein said first and second switches are opened to dissipate the holding current from said solenoid.

* * * * *